United States Patent [19]

Stobb

[11] 3,982,749

[45] Sept. 28, 1976

[54] SIGNATURE FEEDER

[75] Inventor: Anton R. Stobb, Pittstown, N.J.

[73] Assignee: Stobb, Inc., Clinton, N.J.

[22] Filed: July 7, 1975

[21] Appl. No.: 593,848

[52] U.S. Cl. ..... 271/4; 271/7; 271/34; 271/117; 271/126; 271/149

[51] Int. Cl.[2] ..... B65H 3/04; B65H 5/02; B65H 29/16

[58] Field of Search ..... 271/3.1, 4, 6, 7, 117, 271/126, 149–152, 154, 155, 34; 214/8.5 A

[56] References Cited

UNITED STATES PATENTS

| | | | |
|---|---|---|---|
| 572,154 | 12/1896 | Briggs et al. | 271/151 |
| 652,821 | 7/1900 | Vail et al. | 271/34 |
| 1,046,070 | 12/1912 | Jerome | 271/34 |
| 3,522,943 | 8/1970 | Swanson | 271/6 |
| 3,635,463 | 1/1972 | Stobb | 271/34 |
| 3,741,413 | 6/1973 | Friel | 271/6 |
| 3,894,732 | 7/1975 | Muller | 271/34 |

*Primary Examiner*—Robert W. Saifer
*Attorney, Agent, or Firm*—Arthur J. Hansmann

[57] ABSTRACT

A signature feeder with a stack-supporting conveyor for moving a stack of signatures to a dispensing location. A pick-up conveyor engages the stack and positions the signatures in an imbricated stream and a guide member directs them to a deposit location where the signatures are again placed into a stack from whence they are dispensed to a feeder mechanism. Sensors are disposed at the forward face of the stack and also at the deposit location, and the sensors are connected to electric motors which in turn drive either the stack-supporting conveyor or the pick-up conveyor.

7 Claims, 2 Drawing Figures

SIGNATURE FEEDER

This invention relates to a signature feeder, and, more particularly, it relates to apparatus for conveying a stack of signatures to a dispenser from whence the signatures are placed in an imbricated stream and are directed to a deposit and are placed in a stack from whence the signatures are fed to a signature feeder mechanism.

BACKGROUND OF THE INVENTION

The graphic arts industry is concerned with the matter of handling printed signatures or sheets to the extent of receiving the signatures from a printing press or folder and feeding them to a feeder mechanism which collates the signatures into a magazine or book form of a collection of several different printed signatures. In this regard, the stack of signatures produced by the printing press or stacker is commonly secured or bundled and is transported to a feeder mechanism which does the collating. In this activity, it is important that the secured or bundled stack of signatures be conveniently disposed on apparatus for dispensing the stack to the feeder mechanism, and the dispensing must be such that the signatures are presented to the feeding mechanism in desired quantities and in a continuous manner so that the entire equipment and apparatus can be continuously utilized in a productive manner. In this regard, various forms of mechanisms have been created and utilized for depositing signatures in a feeder mechanism, and of course such mechanisms have improved upon the manual labor manner of picking up a portion of a stack of signatures and placing that portion on the feeder mechanism.

For instance, my U.S. Pat. Nos. 3,825,134 and 3,853,243 both show inventions in the sheet stack handling art, such that a stack of signatures can be positioned in a dispensing conveyor which in turn takes the signatures individually to the feeder mechanism, all as desired. Further, my U.S. Pat. No. 3,635,463 also shows apparatus for feeding sheets off a stack of sheets and into a feeder type of mechanism where the sheets are presented one by one. In the last-mentioned patent, there is a stack carrier which receives the full stack of sheets and which advances the stack upwardly on an inclined plane to where the uppermost sheet is moved off the stack and the sheets are actually positioned in a second but smaller stack and in a hopper adjacent a feeder mechanism which takes the sheets from the smaller stack. In this arrangement, the patent show that the apparatus utilizes conveyor mechanism for moving the stack and it utilizes belts for taking the sheets off the stack and placing them into the feeder mechanism hopper.

The present invention is concerned with this type of signature feeder mechanism, and it provides the feeder mechanism wherein the original stacks can be continuously and uniformly presented to the dispensing location where the sheets are then engaged by a conveyor which positions the sheets in imbricated stream and takes them to a deposit location where the sheets are again placed in a stack adjacent a feeder mechanism. In this present arrangement, provision is made for accurately feeding the sheets from the stack and to the dispensing location, and in the actual embodiment shown herein, the pick-up or feeder conveyor is arranged to be adjustable so that the degree of imbrication or spacing between the sheets is controlled, and the pick-up conveyor is reliable in that it is in full control of the sheets at the forward face of the stack and thus can pick them up and securely and reliably feed them into the stream and to the dispensing station.

Still further, the present invention provides apparatus for controlling the rate of feeding the sheets from the stack to the dispensing location, and the control is automatic through electric sensors and electric motors which drive both the stack carrier and the pick-up conveyor.

Still further, the present invention provides apparatus for jogging the small stack in the dispensor location adjacent the feeder mechanism so that the signatures are in the best position for pick-up by the feeder mechanism.

In summary, the present invention provides a reliable and accurate apparatus for receiving a stack of sheets and automatically feeding the sheets or signatures from the stack and to a dispensing location from whence the sheets can be fed to the feeder mechanism.

Other objects and advantages will become apparent upon reading the following description in light of the accompanying drawings.

DETAILED DESCRIPTION OF THE PREFERRED EMBODIMENT

Figure 1:
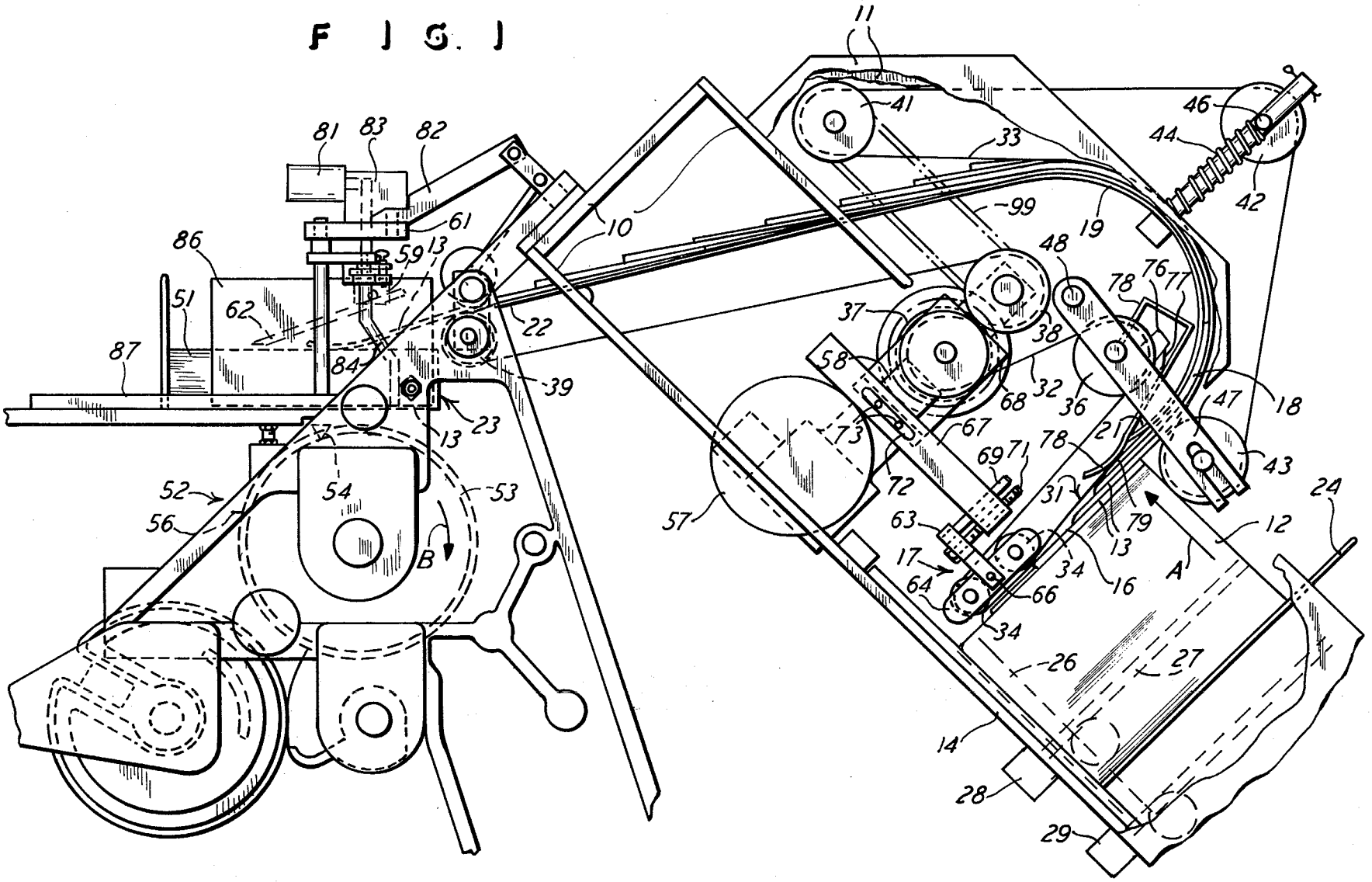
FIG. 1 is a side elevational view of apparatus embodying this invention, with parts thereof broken away.

The drawings show frame support members 10 and frame side plates 11 which are all secured together in a fixed relationship and which thereby provide support for the remaining parts and components. A stack 12 of signatures 13 is movably supported on the lower frame portion designated 14 which is at an inclined angle so that the stack 12 can be moved in an upright or upwardly direction and present a forward face 16 to a pick-up conveyor generally designated 17. The signatures 13 are thus placed in a stream shown at 18, and a curved guide plate or member 19 extends from one end 21 to another end 22 to guide to the stream 18 from the stack 12 and to a deposit station designated 23. Thus, the initial stack 12 is taken from a stacker or packer device which is not shown, and it is positioned on the feeder shown in FIG. 1 and is moved upwardly in the direction of the arrow designated A as the stack rests against a support plate 24 which is supported on the apparatus frame described and which is engaged by carrier conveyors which move upwardly along the frame 14, in a conventional arrangement and manner, and the carrier conveyors are indicated at 26 which shows the portion of the conveyor extending next to and parallel with the frame member 14 and which also shows shafts 27 which are suitably rotatably supported on the frame members for transmitting the power of the electric motors 28 and 29 to the respective so-called upper and lower carrier conveyors. That is, the arrangement will be such that anyone skilled in the art will readily understand it and be able to make it, and the general arrangement of an upper and lower carrier conveyor as shown and described herein can be as revealed in my U.S. Pat. Nos. 3,416,679 and 3,635,463, except as otherwise described herein. Also, reference may be had to my U.S. Pat. Nos. 3,825,134 and 3,853,234 for a showing of the general handling of signatures which are initially placed into a stack and which are subsequently disposed on a feeder mechanism which takes the signatures individually to the feeder mechanism and collator. Thus, it will be understood that the apparatus shown herein includes a feeder mechanism support frame and an upper and a lower conveyor carrier, including the described elements 26 and 27 which are comparable to those shown in the reference patents, and the apparatus therefore handles two stacks 12 which are of course sequentially presented to the pick-up mechanism 17 for placing the signatures 13 into the stream 18 and, by other mechanism to be described here and after, directing the stream 18 to the dispensing location 23. In this arrangement, the electric motors 28 and 29 respectively drive the upper and lower carrier conveyors in the arrangement and in the manner shown with respect to the upper and lower carrier conveyors and respective drive motors described in my U.S. Pat. Nos. 3,416,679, for instance.

The guide member 19 therefore extends from the forward face 16 of the stack 12 and around to the dispensing station 23, and the stream 18 is generally upwardly supported on the curved guide plate 19, as shown. The pick-up mechanism 17 is part of a pick-up conveyor generally designated 31 and which includes a belt 32, disposed underneath the stream 18 and a belt 33, disposed above the stream 18 and around the curved portion of the guide member 19. The pick-up conveyor also therefore includes the two rollers 34 and the pulleys 36, 37, 38, and the brush-type roller 39. Thus the belt 32 is trained over these rollers and pulleys mentioned, and it also extends over the guide plate 19, as shown.

The belt 33 extends over the pulleys 41, 42, and 43. All of the pulleys mentioned are therefore suitable mounted on the shafts shown and the shafts of course are suitably supported in the frame of the feeder mechanism described and as shown and certainly as will be understood by one skilled in the art. As shown, the belt 33 is kept under tension by means of a compression spring 44 which bears against the shaft 46 of the pulley 42 and which therefore moves the pulley 42 upwardly or away from the pulleys 41 and 43 to thereby create the tension in the belt 33. Also, the pulley 43 is shown supported on an arm 47 which is pivoted on a shaft 48 suitably supported on the frame, such as between the side plates 11, and the pulley 36 is also shown supported on the pivot arm 47. Therefore, suitable tension in the belt 33, as provided by the force of the spring 44, will also cause the arm 47 to create a tension on the belt 32 by virtue of moving the pulley 36 upwardly, all as indicated.

From the deposit station 23, the signatures 13 are formed in a stack designated 51, and, from that point, conventional feeder pick-up mechanism generally designated 52 can engage the bottom signature 13 at the point indicated so that the feeder pick-up cylinder 53, such as through it suction member 54, can take the bottom signature signature 13 from the stack 51 and move it on the drum 53 in the direction of the arrow B and to a stop designated 56 from where the signature can be released and placed on a collecting conveyor or chain, in the usual manner. That is, the portion of the mechanism designated 52, that is the portion which receives the signatures from the stack 51, is conventional and forms no part of this invention.

Figure 2:
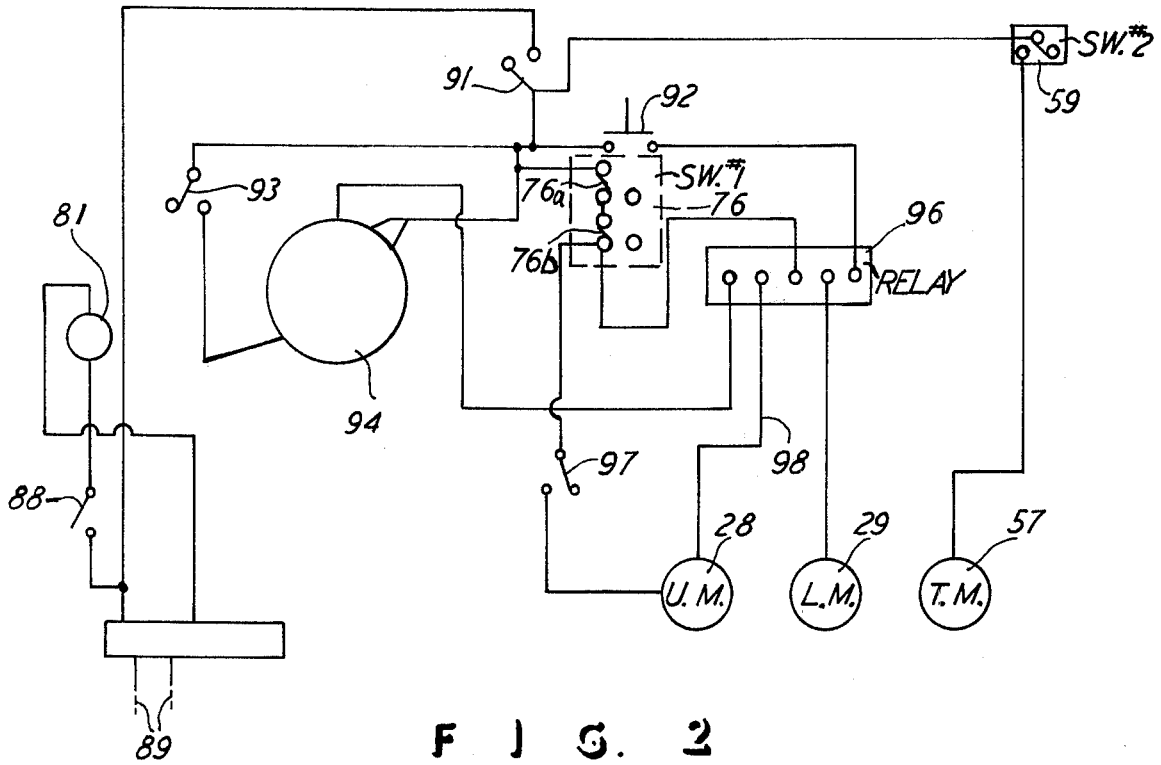
FIG. 2 is an electric wiring diagram of some of the apparatus utilized in the embodiment in FIG. 1.

An electric motor 57 is suitably mounted on the frame 10, and it has its drive mechanism 58 extending into rotary drive relation with the pulley 37, and thus the belt 32 is driven. A micro-switch 59 is of a conventional arrangement and is suitably mounted on the apparatus frame portion designated 61, and it has an arm 62 extending down to the top of the stack 51. The arm 62 is pivotal on the switch body itself, in any conventional arrangement, so that the switch 59 and its arm 62 provide an electric sensor for detecting the height of the stack 51. Also, the switch 59 is electrically connected with the motor 57, such as shown in FIG. 2, and thus the switch 59 controls the running of the motor 57 and therefore it controls the pick-up of the signatures 13 from the stack 12 since the conveyor pick-up portion 17 is therefore governed by the operation of the motor 57. Also, the pick-up mechanism 17 includes the two rollers 34 and that portion of the belt 32 which extends over the rollers 34 and it includes an adjustable mechanism consisting of an arm 63 which in turn pivotally supports an arm 64 through a pivot pin 66 connecting the arms 63 and 64 together, and the arm 64 exists on each side of the rollers 34 and rotatably supports the rollers 34. Another arm 67 is connected to the frame in any suitable manner and as indicated through the plate 68 and as here-and-after described, and the arm 67 receives a guide pin 69 and a threaded bolt 71. Therefore, with the pin 69 and bolt 71 extending through the arms 63 and 67, threaded adjustment of the bolt 71 in the threaded opening in the arm 67 will move the arm 63 toward and away from the arm 67 and will thus position the rollers 34 in a relative up and down position along the stack face 16. With this adjustment, the spacing of the imbrication or end-to-end relation of the signatures in the stream 18 can be governed. That is, if the arm 63 is positioned closer to the arm 67, then the pick-up mechanism 17 will not move the next signature out of the stack 12 as soon as it would if the arm 63 were moved downwardly or away from the arm 67.

Also, the arm 67 is floatingly mounted so that its weight and that of the pick-up mechanism 17 will simply bear against the stack face or forward portion 16 to have the pick-up mechanism 17 in contact with the stack face 16, as desired. This arrangement could be through a slot 72 extending along the arm 67 and guide pin 73 can be on the support plate 68, and thus the entire pick-up mechanism 17 will float and adjust its position relative to the elevated position of the stack face 16, and thereby the pick-up mechanism 17 will always be in desired operative contact with the stack 12.

Another micro-switch 76 is suitably mounted on the frame and has an arm 77 pivotally mounted on the switch body and extending therefrom, such as in the manner indicated. Another arm 78 is mounted on the frame and extends to an end 79 which is in sliding contact with the signature stream 18, and the arm 78 can move in response to the pressure thereon and from the stream 18, such that the arm 78 will pivot or move against the switch arm 77 and thereby actuate the switch 76, in any conventional arrangement of a switch of the required and desired nature for the purpose shown and described herein, and also as shown in FIG. 2. Accordingly, when the stream 18 is of a certain thickness, or thinness, then the switch 76 will sense that condition and will in turn control the power to the carrier motors 28 and 29, again as indicated also in FIG. 2.

Accordingly, there are the two electric sensor switches and there are their respective motors controlled thereby, and the motors in turn control the conveyors for movement of the signatures to the stack 51, all as shown and described and as will be understood by one skilled in the art.

Also, the dispensing station 23 can have jogger mechanism thereon, and therefore an electric jogger motor 81 is suitably supported on the frame portions 82 through and with a gear box or the like 83 which in turn is connected to a jogger rod or member 84. The member 84 is suitably arranged with side plates 86 flanging the stack 51, and thus the plates 86 are vibrated by the motor 81 and therefore the stack 51 is jogged so that its edges will be neatly aligned in the stack 51.

FIG. 2 shows the arrangement of the electrical parts, and here it will be seen that the switch 76 is identified as switch No. 1 and the switch 59 is identified as switch No. 2, and these switches respectively control the motors 28 and 29 and 57 which are respectively identified as the upper carrier motor and the lower carrier motor and the table motor which is the table designated 87 at the dispensing station 23. Also, the jogger motor 81 is shown, and there is a switch 88 in the diagram in FIG. 2 for controlling the motor 81, and the entire arrangement shows the power line at 89. Also, the entire system has an off-on switch 91 and a starter switch 92 and it shows a switch 93 which controls the pulse change from between the upper and lower motors 28 and 29 and does so through the conventional connection designated 94 and which is connected with the switch 76 and a latching relay 96. There is also a switch 97 which is available for use in avoiding jamming of the signatures, if necessary to use it. The diagram in FIG. 2 also shows the necessary wire connections between the components shown and described, such as the one wire designated 98 extending between the relay 96 and the motor 28, by way of example.

With the arrangement described, the two switches 59 and 76 control their respective motors and thus control the movement of the signatures to the dispensing station 23. Also, the switch 93 and connection 94 and relay 96, along with the components shown, suitably control energizing or pulsing of the respective motors for moving the upper and lower carriers, as mentioned. Thus, the switch 76 actually shows two switch sections 76A and 76B for performing the function of alternate control of the motors 28 and 29, and standardized switches and relay 96 and like components can be applied for the purpose described herein. The latching relay 96 thus controls the drive between the motors 28 and 29, including reversing the same, and this is a conventional switching arrangement except for its environment herein and as described and claimed herein. Also, for synchronizing drive between the conveyors 31 and 33, or the belts thereof as described, a drive chain designated 99 is in driving relation between the pulley or like 38 and the pulley or the like 41, and thus the signatures in the stream 18 are smoothly and uniformly carried around the curved portion of the guide member 19 and between the belts 32 and 33, as shown.

What is claimed is:

1. A signature feeder comprising a support frame, a stack-supporting conveyor movably disposed on said frame in an uprightly inclined orientation for supporting said stack in an uprightly inclined orientation for transporting a stack of signatures in the direction of the longitudinal axis of the stack and to a dispensing location, a signature pick-up conveyor movably supported on said frame and extending to said dispensing location and having a portion disposed in contact with the face of the stack at the forward end of the stack, said portion including a conveyor belt movable across the forward face of said stack for disposing the signatures in an imbricated stream of signatures, a guide member fixedly disposed on said frame adjacent said conveyor belt for receiving the imbricated stream of signatures and extending to a deposit location location where the signatures are passed beyond the control of said guide member, and an adjustable support disposed adjacent the forward face of the stack and with said conveyor belt being trained on said support, said support including adjustable members adjustably positionable along the forward face of the stack to adjustably position said conveyor belt for engaging said sheets at a selected position on said sheet for establishing the amount of imbrication between consecutive ones of said sheets.

2. The signature feeder as claimed in claim 1, including a movable mounting for said adjustable support and arranged in a manner to have said adjustable support with said conveyor belt thereon movable along the longitudinally uprightly inclined axis of the stack for adjusting to the position of the forward face of the stack.

3. The signature feeder as claimed in claim 1, wherein said conveyor belt is supported on two rollers spaced apart along the forward face of the stack, and with said two rollers being mounted on a common support extending therebetween, and with said common support being pivotally mounted intermediate said rollers in a manner adapted to have said rollers apply equal pressure to the forward face of the stack.

4. The signature feeder as claimed in claim 1, including a sensor disposed in contact with the imbricated stream, a motor operatively connected with said stack-supporting conveyor for moving the latter, and connections connected between said sensor and said motor for operation of said motor and consequent movement of the stack in response to the reaction of said sensor to said imbricated stream.

5. The signature feeder as claimed in claim 4, including a second sensor in contact with the sheets at the deposit location, a second motor operatively connected with said signature pick-up conveyor for moving the latter, and connections connected between said second sensor and said second motor for operation of said second motor and consequent movement of said pick-up conveyor in accordance with the amounts of the sheets at the deposit location.

6. The signature feeder as claimed in claim 1, wherein said guide member is a curved plate, and said pick-up conveyor extends over the top of said plate.

7. The signature feeder as caimed in claim 1, including two of said stack-supporting conveyors movably disposed on said frame for each to transport a stack of sheets, and two motors electrically and respectively operatively connected with said two stack-supporting conveyors for moving the latter, and a sensor and an electric relay connected with said two motors for controlling the operation of said two motors and with said sensor being in contact with the imbricated stream and arranged to be responsive to the sheets moving in said stream and to thereby accordingly control said two motors.

* * * * *